United States Patent [19]

Knotts

[11] Patent Number: 4,778,415

[45] Date of Patent: Oct. 18, 1988

[54] DEVICE FOR MOUNTING AN OUTBOARD MOTOR TO A BOAT TRANSOM

[76] Inventor: Chales A. Knotts, 14 Fairway Dr., Floyd Knobs, Ind. 47119

[21] Appl. No.: 8,349

[22] Filed: Jan. 29, 1987

[51] Int. Cl.[4] ..... B63H 5/12

[52] U.S. Cl. ..... 440/59; 440/61; 248/640

[58] Field of Search ..... 440/53, 58, 59, 60, 440/61, 62; 248/640, 641, 642, 643

[56] References Cited

U.S. PATENT DOCUMENTS

| | | | |
|---|---|---|---|
| 2,631,799 | 3/1953 | Poulin | 440/60 |
| 2,928,631 | 3/1960 | Hartman | 440/59 |
| 4,089,290 | 5/1978 | Miles et al. | 440/61 |
| 4,143,614 | 3/1979 | Jeanson et al. | 440/61 |
| 4,482,330 | 11/1984 | Cook | 440/61 |
| 4,624,438 | 11/1986 | Goodman | 440/61 |

*Primary Examiner*—Joseph F. Peters, Jr.
*Assistant Examiner*—Stephen P. Avila
*Attorney, Agent, or Firm*—Jon C. Winger

[57] ABSTRACT

A device for mounting an outboard motor to the transom of a boat so that the motor can be selectively raised and lowered relative to the boat transom and so that the motor can be tilted at an angle to the vertical. The outboard motor mounting device includes a transom mounting fixture to be attached to the boat transom, and an outboard motor mounting fixture interconnected to the transom mounting fixture for selected linear movement on the transom mounting fixture up or down relative to the boat transom, and for selected pivotal movement on the transom mounting fixture about a horizontal tilt axis in the direction of the longitudinal axis of the boat.

9 Claims, 4 Drawing Sheets

DEVICE FOR MOUNTING AN OUTBOARD MOTOR TO A BOAT TRANSOM

BACKGROUND OF THE INVENTION

The present invention relates generally to outboard motors, and more particularly to apparatus for mounting an outboard motor to a boat transom providing for both the vertical positioning and tilting of the outboard motor on a boat transom.

Obviously, boats and motors come in different physical sizes, weights and horsepower. Furthermore, boats and outboard motors are made by different manufacturers and, therefore, it is virtually impossible that any given outboard motor will mate with any given boat to provide optimum performance.

For example, for best operation at speed, the cavitation plate of the outboard motor should be at the surface of the water to prevent air from reaching the prop. The vertical positioning of the ourboard motor on the boat transom will determine the position of the cavitation plate. This positioning will, of course, be different with different boat and motor combinations.

Further, the tilt of the outboard motor relative to the boat transom also is important. For example, a negative trim or tilt positions the prop at such an angle to generate a thrust vector in a direction to prevent the bow of the boat from raising up thus getting the boat on plane faster. In addition, a negative trim improves handling of the boat at low speeds in rougt water. A positive motor tilt or trim positions the prop at such an angle to generate a thrust vector more in align with the longitudinal axis of the boat at operating speed, thusly, providing a larger thrust vector component for propelling the boat in a forward direction. This tilt or trim positioning will be affected by the angle of the transom of the boat which varies from boat design and between boat manufactures.

It is also desirable that the outboard motor be positioned rearwardly enough of the boat transom to locate the prop beyond the disturbed water created by the boat hull trailing the transom as the boat moves through the water.

Various devices for adjustably positioning the outboard motor on the boat transom and other devices for adjustably tilting the outboard motor on the boat transom are known to the art. Examples of such devices are shown in U.S. Pat. Nos. 2,928,631 issued to C. G. Hartman; 4,099,479 issued to Tetsuya Arimitsv; 4,402,675 issued to Charles H. Eichinger; 4,406,634 issued to Clarence E. Blanchard; and 4,482,330 issued to Greg Cook.

SUMMARY OF THE INVENTION

It is an object of the present invention to provide a device for mounting an outboard motor to a boat transom providing for the vertical positioning of the outboard motor as well as the tilted or trim position of the outboard motor relative to the boat transom.

it is another object of the present invention to provide a motor mounting device of the class described which provide for infinitely varying, between limits, the vertical position of the outboard motor and infinitely varying, between limits, the tilt angle or trim of the outboard motor.

It is a further object of the present invention to provide a motor mounting device of the class described which positions the motor behind the boat transom sufficiently to locate the motor prop beyond the disturbed water generated by boat hull as it moves through the water.

More particularly, the present invention provides a device for mounting an outboard motor on the transom of a boat so that the motor can be selectively raised, lowered, and tilted relative to the boat transom comprising a transom mounting fixture to be attached to the transom of the boat; and a motor mounting fixture to which the outboard motor is attached, the transom mounting fixture being interconnected to the transom mounting fixture for vertical linear movement therealong relative to the boat transom and for pivotal movement on the transom mounting fixture about a horizontal axis parallel to the plane of the boat transom such that the motor mounting fixture moves in the plane of the longitudinal axis of the boat.

BRIEF DESCRIPTION OF THE DRAWING

A better understanding of the invention will be had upon reference to the following description in conjunction with the accompanying drawings wherein like numerals refer to like parts throughout the several views and in which.

DETAILED DESCRIPTION OF THE PREFERRED EMBODIMENT

Figure 1:
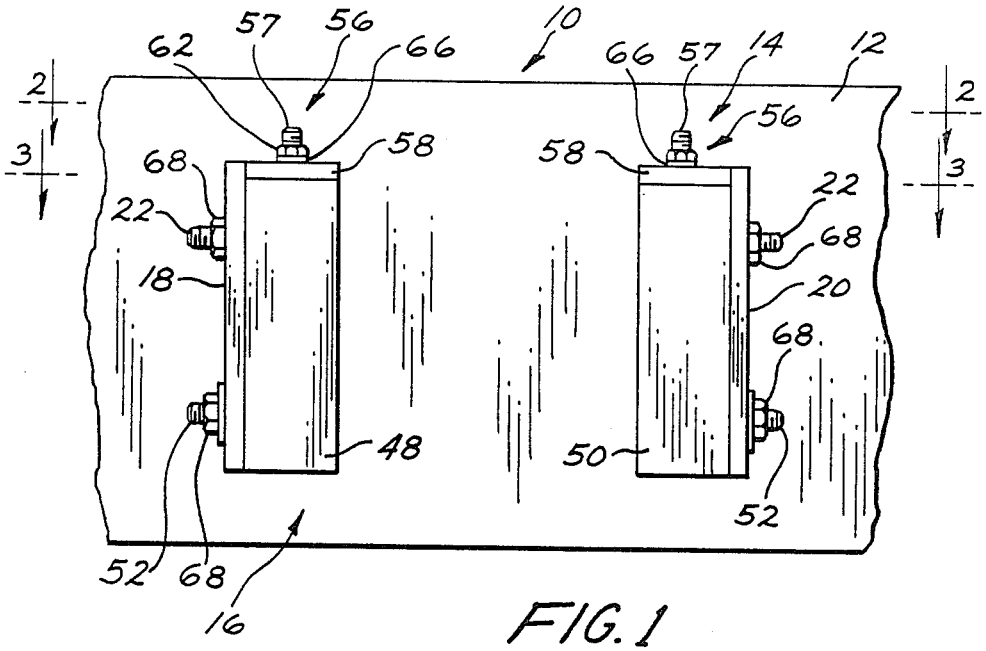
FIG. 1 is a front view of the outboard motor mounting device of the present invention.
Figure 2:
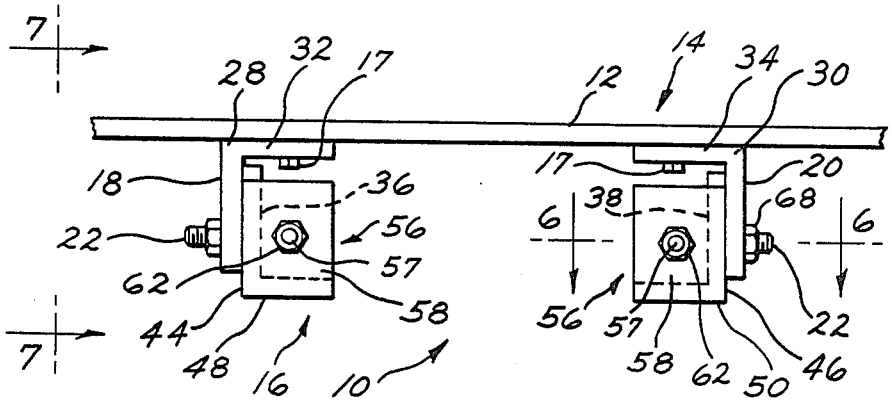
FIG. 2 is a top view of the outboard motor mounting device as seen in the direction of arrows 2—2 in FIG. 1.

With reference to FIGS. 1 and 2, there is shown a device, generally denoted as the numeral 10, of the present invention for attachment to a boat for mounting an outboard motor (not shown) to the transom 12 of the boat.

The device 10 consists of a transom mounting fixture, generally denoted by the numeral 14, and a motor mounting fixture, generally denoted as the numeral 16.

The transom mounting fixture 14 is attached to transom 12 by means of fasteners 17, such as bolts which extend through appropriate holes in the transom mounting fixture 14 and into the boat transom 12.

The outboard motor mounting fixture 16 is interconnected to the transom mounting fixture 14 for selected linear movement thereon in a vertical direction relative to the boat transom 12, and also for selected pivotal movement on the transom mounting fixture 14 about a horizontal tilt axis and in the direction of the longitudinal axis of the boat to which the outboard motor mounting device 10 is attached.

The outboard motor (not shown) can be mounted onto the outboard mounting fixture 16 in the same manner as it would otherwise be mounted to the boat transom.

With continued reference to FIGS. 1–7, the transom mounting fixture 14 comprises a pair of elongated flanges 18 and 20 spaced apart from eah other symetrically of the centerline of the boat transom 12, parallel to each other, and vertically positioned. A different one of two motor mounting fixture pivot pins 22 projects from each of the vertical elongated flanges 18 and 20 into the space between the elongated flanges 18 and 20 in coaxial alignment with each other to define the horizontal tilt axis of the motor mounting fixture 16. Toward this end, each pivot pin 22 is received through a hole 24 formed in each of the flanges 18 and 20. In addition, a slot 26 is formed in each of the vertical flanges 18 and 20 spaced a distance from the pviot pin receiving hole 24. The major axis of the slot 26 is generally transverse to the direction of vertical movement of the motor mounting fixture 16, and the minor axis or centerline of the slot 26 is in alignment with the centerline of the pivot pin receiving hole 24.

Preferably, as shown, the transom mounting fixture 14 comprises two separate transom mounting brackets 28 and 30. The transom mounting brackets 28 and 30 are mirror images of each other. In transverse cross-section (see FIGS. 1 and 3) each transom mounting bracket 28 and 30 is L-shaped. One leg of the L-shaped transom mounting bracket 28 forms the flange 18, and the other leg of the L-shape forms an attachment plate 32 which fits flush against the boat transom 12. Similarly, one leg of the L-shaped transom mounting bracket 30 forms the flange 20, and the other leg of the L-shape forms an attachment plate 34 which fits flush against the boat transom 12. The fasteners or bolts 17 are received through appropriate holes in the attachment plates 32 and 34, thus, attaching the transom mounting brackets 28 and 30 to the boat transom 12. The transom mounting brackets 28 and 30 are positioned in spaced apart relationship to each other symetrically to opposite sides of the centerline of the boat transom 12.

Alternatively, the transom mounting fixture 14 can be of a unitary construction formed with the two flanges 18 and 20 attached to a single, common transom attachment plate 32, 34. However, the use of two transom mounting brackets 28 and 30 forming the transom mounting fixture 14 is preferable because it provides for the use of the outboard motor mounting device 10 of one size with a variety of different sized boats and motors, and combinations of different sized boats and different sized motors merely by attaching the transom mounting brackets 28 and 30 to the boat transom 12 with an appropriate space therebetween to suit different boats and motors.

Still referring to FIGS. 1–7, the motor mounting fixture 16 comprises a pair of parallel, elongated flanges 36 and 38 spaced apart from each other by a distance less than the distance between the transom mounting fixture flanges 18 and 20. The pair of motor mounting fixture flanges 36 and 38 are received within the space between the transom mounting fixture flanges 18 and 20 with one motor mounting fixture flange 36 located in parallel juxtaposition with one transom mounting fixture flange 18, and the other one of the motor mounting fixture flanges 38 in parallel juxtaposition with the other one of the transom mounting fixture flange 20. A first elongated slot 40 is formed in each of the motor mounting fixture flanges 36 and 38 with the major axis of the first slot 40 in the direction of the vertical movement of the motor mounting fixture 16, that is, the major axis of the first slot 40 is parallel to the longitudinal axis of the elongated flanges 36 and 38. The motor mounting fixture pivot pin 22 received through the hole 24 in the transom mounting fixture flange 18 is also received through the first elongated slot 40 in the motor mounting fixture flange 36 in juxtaposition to the flange 18, and the motor mounting fixture pivot pin 22 received through the hole 24 in the other transom mounting fixture flange 20 is also received through, the first elongated slot 40 in the motor mounting fixture flange 38 in juxtaposition to the flange 20. A second elongated slot 42 is formed in each of the mmotor mounting fixture flanges 36, 38 spaced a distance from the first elongated slot 40 with the major axis of the second slot 42 in alignment with the major axis of the first elongated slot 42.

Preferably, as shown, the motor mounting fixture 16 comprises to separate motor mounting brackets 44 and 46. The transom mounting brackets 44 and 46 are mirror images of each other. In transverse cross-section (see FIGS. 1–3) each motor mounting bracket 44 and 46 is L-shaped. One leg of the L-shaped motor mounting bracket 44 forms the flange 36, and the other leg of the L-shape forms a motor attachment plate 48 to which the outboard motor is directly attached. Similarly, one leg of the L-shaped motor mounting bracket 46 forms the flange 38, and the other leg of the L-shape forms a motor attachment plate 50 to which the outboard motor is directly attached.

Alternatively, the motor mounting fixture 16 can be of a unitary construction formed with the two flanges 36 and 38 attached to a single, common motor attachment plate 48, 50. However, the use of two motor mounting brackets 44 and 46 forming the motor mounting fixture 16 is preferable because it provides for the use of the outboard motor mounting device 10 of one size with a variety of different sized boats and motors, and combinations of different sized boats and different sized motors.

A different one of two motor mounting fixture-locking pins 52 is received through the slot 26 in each of the transom mounting fixture flanges 18 and 20 and through the second slot 42 in each of the motor mounting fixture flanges 36 and 38. That is, one of the motor mounting fixture locking pins 52 is received through the slot 26 in the transom mounting fixture flange 18 and through the second slot 42 in the motor mounting fixture flange 36 which is in juxtaposition to the transom mounting fixture flange 18. Similarly, the other one of the motor mounting fixture locking pins 52 is received through the slot 26 in the transom mounting fixture flange 20 and through the second slot 42 in the motor mounting fixture flange 38 which is in juxtaposition to the transom mounting fixture flange 20.

Figure 6:
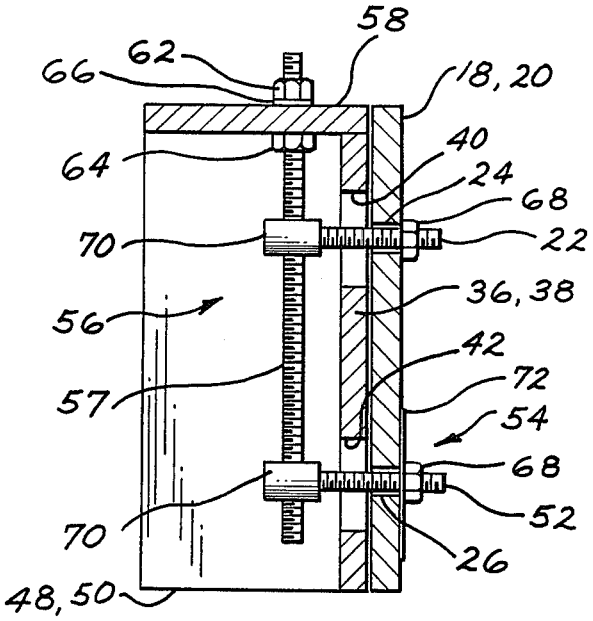
FIG. 6 is a cross-sectional view as seen in the direction of arrows 6—6 in FIG. 2.
Figure 7:
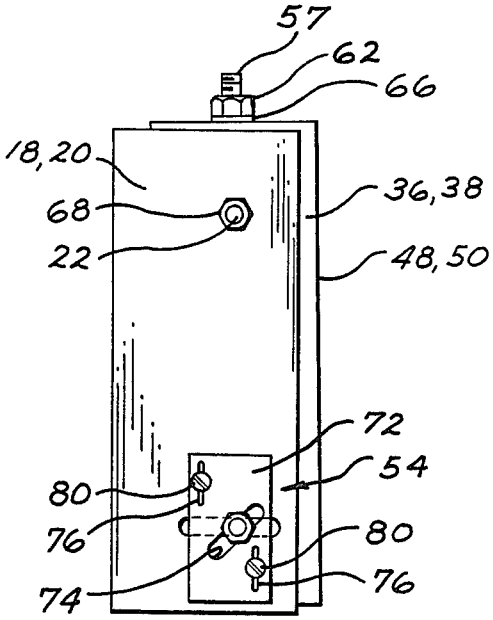
FIG. 7 is a side view as seen in the direction of arrows 7—7 in FIG. 2.

With reference to FIGS. 6 and 7, lock means, generally denoted as the numeral 54, associated with the motor mounting fixture locking pins 52 is provided to prevent the locking pins 52 from inadvertently moving in the slots 26 of the transom mounting fixture flanges 18 and 20, and to prevent the locking pins 52 from inadvertently moving in the second slots 42 of the motor mounting fixture flanges 36 and 38. Thusly, the lock means 54 holds the motor mounting fixture 16 in the desired position against inadvertent movement in both the selected raised position and tilted position. The lock means 54 will be described in more detail hereinafter.

With reference to FIGS. 1–3, 5 and 6, the outboard motor mounting device 10 also comprises jack screw means, generally denoted as the numeral 56, which provides for the selected linear movement of the motor mounting fixture 16 in the raised and lowered direction relative to the transom mounting fixture 14 defined by the direction of the major axis of the first elongated slots 40 and second elongated slots 42 in the motor mounting fixture flanges 36 and 38. As shown, the jack screw means 56 comprises a jack screw 57 associated with each of the motor mounting brackets 44 and 46. Because the motor mounting brackets 44 and 46 are identical, for the sake of brevity and clearness of understanding only one of the motor mounting brackets, for example bracket 44, will be discussed. It should be clearly understood the description applies equally to the other motor mounting bracket 46 as well. The motor mounting bracket 44 includes a jack screw mounting plate 58 affixed to the top end of the motor mounting bracket 44. As shown, the jack screw mounting plate 58 is positioned to sit on the top edge of both the flange 36 and motor attachment plate 48. The jack screw mounting plate 58 includes a jack screw receiving hole 60 having its longitudinal central axis generally in parallel alignment with the major axis of the elongated slots 40 and 42 in the elongated flange 36 of the bracket 44. As can be best seen in FIG. 6, the jack screw 57 is disposed in parallel with the major axis of the slots 40 and 42 with one end projecting upwardly through the jack screw receiving hole 60. As illustrated, the jack screw 57 is attached to the jack screw mounting plate 58 by means of a threaded fasteners 62 and 64 such as, for example, machine nuts. The threaded fastener 62 is threaded over the jack screw 57 to the underside of the jack screw mounting plate 58 with a thrust washer 66 between the threaded fastener 62 and underside of the jack screw mounting plate 58 and the other threaded fastener 64 is threaded over the protruding end of the jack screw 57 with a thrust washer 66 located between the threaded fastener 64 and top side of the jack screw mounting plate 58. Thus, the jack screw 57 is held fast against longitudinal movement, but is allowed to be rotated about its longitudinal axis.

Figure 3:
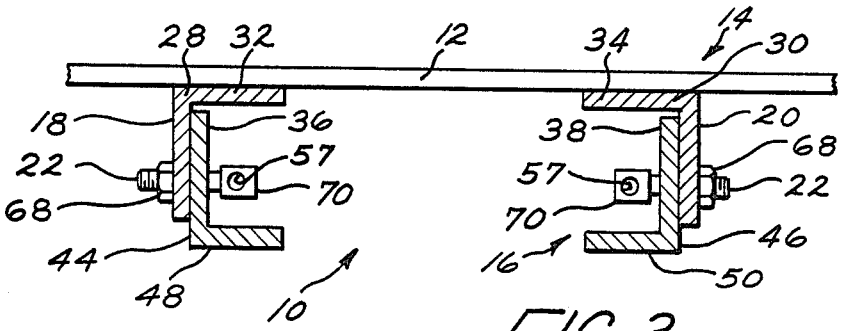
FIG. 3 is a cross-sectional view as seen in the direction of arrows 3—3 in FIG. 1.
Figure 4:
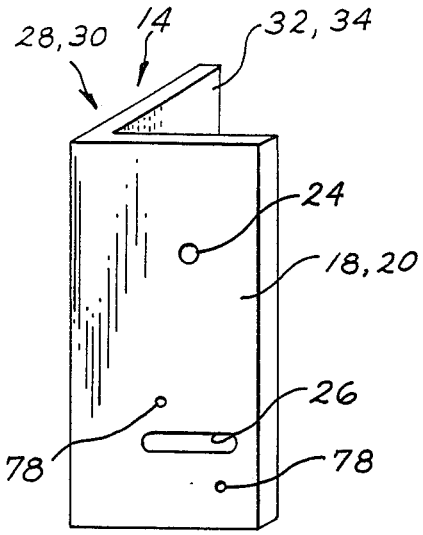
FIG. 4 is a perspective view of one component of the present invention.
Figure 5:
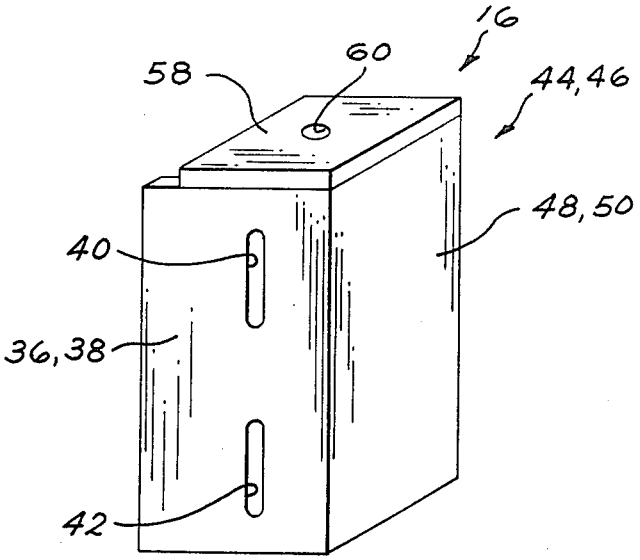
FIG. 5 is a perspective view of another component of the present invention.

As can be best seen in FIGS. 3 and 6, the pivot pin 22 and locking pin 52 are attached to the jack screw 57 at different, spaced apart locations along the length of the jack screw 57 and extend in parallel relationship to each other from the jack screw 57 at a right angle to the longitudinal axis of the jack screw 57. The pivot pin 22 extends through first elongated slot 40 in the flange 36 of the motor attachment bracket 44 and through the pivot pin hole 24 in the flange 18 of the transom mounting bracket 28. The locking pin 52 extends through the second elongated slot 42 in the flange 36 of the motor attachment bracket 44 and through the elongated slot 26 in the flange 18 of the transom mounting bracket 28. A threaded fastener 68, such as machine nut, is threaded over the end of the pivot pin 22 protruding through the hole 24 of the flange 18 of the transom mounting bracket 28 against the surface of the flange 18. Similarly, another threaded fastener 68 is threaded over the end of the locking pin 52 protruding through the elongated slot 26 of the flange 18 of the transom mounting bracket 28 against the surface of the flange 18. The attachment of each of the pivot pin 22 and the locking pin 52 to the jack screw 57 comprises a collar 70 affixed to one end of the pin. The collar 70 has an internally threaded aperture therethrough which threadably receives the jack screw 57.

Figure 8:
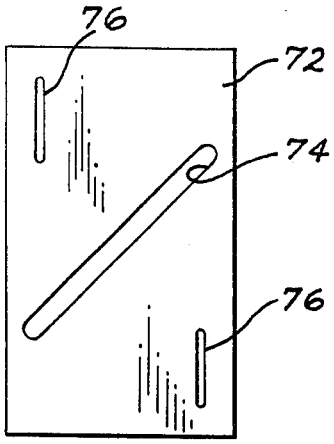
FIG. 8 is a view of a tilt lock component of the present invention.

As can be seen in FIGS. 6–8, the lock pin locking means 54 comprises a lock plate 72. The lock plate 72 has a diagonal elongated slot 74 and two parallel elongated apertures 76 spaced to either side of the diagonal slot 74 with the major axis of the elongated apertures 76 at an acute angle to the major axis of elongated slot 74. With additional reference to FIG. 5, the lock pin locking means 54 further includes two staggered threaded bores 78 in the flange 18 of the transom mounting bracket 28 spaced to either lateral side of the second elongated slot 26 in the flange 18 and spaced apart from each other longitudinally of the elongated slot 26. The lock plate 72 is positioned on the outside surface of the flange 18 of the transom mounting bracket 28 with each one of the elongated apertures 76 in registration over a different one of the threaded bores 78 and the major axis of the elongated apertures 76 perpendicular to the major axis of the elongated slot 26, and with the major axis of the diagonal slot 74 of the lock plate 72 over the elongated slot 26 at a diagonal to the major axis of the elongated slot 26 in the flange 18 of the transom mounting bracket 28. The lock plate 72 is fastened to the flange 18 of the transom mounting bracket 28 by screws 80 extending through the elongated apertures 76 and threaded into the threaded bores 78 in the flange 18 of the transom mounting bracket 28. The lock pin 52 projects through the second elongated slot 42 in the flange 36 of the motor mounting bracket 44, through the elongated slot 26 in the flange 18 of the transom mounting bracket 28 and through the diagonal slot 74 in the lock plate 72. The threaded fastener 68 on the lock pin 52 is threaded down on the lock pin 52 against the surface of the lock plate 72.

Figure 9:
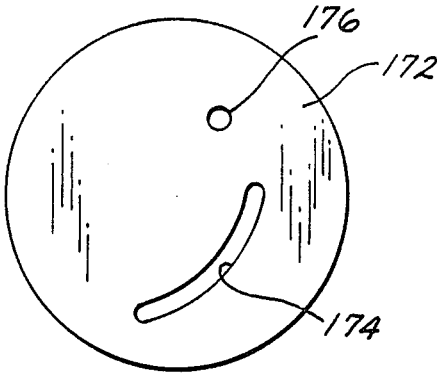
FIG. 9 is a view of an alternative tilt lock component of the present invention.

With reference to FIG. 9, there is shown an alternative embodiment for a lock plate, generally denoted as the numneral 172. The lock plate 172 consists of an aperture 176 and an arcuate slot 174 eccentric to the aperture 176. The lock plate 172 is positioned on the outside surface of the flange 18 of the transom mounting bracket 28 with the aperture 176 in alignment with one of the threaded bores 78 and the arcuate slot 174 laying across the major axis of the elongated slot 26 in the flange 18 of the transom mounting bracket 28. The lock plate 172 is fastened to the flange 18 by a screw 80 extending through the aperture 176 and threaded into the aligned one of the bores 78 in the flange 18. The lock pin 52 projects through the second elongated slot 42 in the flange 36 of the motor mounting bracket 44, through the elongated slot 26 in the flange 18 of the transom mounting bracket 28, and through the arcuate slot 174 in the lock plate 172. The threaded fastener 68 on the lock pin 52 is threaded down on the lock pin 52 against the surface of the lock plate 172.

The diagonal slot 74 of the lock plate 72 and the eccentric arcuate slot 174 of the lock plate 172 prevents movement of the lock pin 52 along the major axis of the slot 26 in the flange 18 of the transom mounting bracket 28, thus, locking the motor mounting bracket 44 against tilting movement about the pivot pin 22.

In operation, to raise or lower the outboard motor affixed to the motor mounting device 10, the jack screws 57 are turned or rotated about the longitudinal axis. For example, as can be best visualized by reference to FIG. 6, assuming the jack screw 57 has a right-handed thread, when the jack screw 57 is turned or rotated in a clockwise direction the jack screw 57 moves longitudinally downwardly in the threaded apertures in the collars 70 of pivot pin 22 and locking pin 52, the collars 70 remaining stationary relative to the jack screw 57 because of the fact that the pivot pin 22 and locking pin 52 are received in the hole 24 and slot 26 of the transom mounting fixture 14. Due to the connection of the jack screw 57 to the jack screw mounting plate 58 of the motor mounting bracket 44, 46 preventing longitudinal movement of the jack screw 57 relative to the motor mounting bracket 44, 46 the motor mounting bracket 44, 46 moves with the jack screw 57 and is lowered relative to the transom mounting fixture 14, thusly, also lowering the motor relative to the boat transom 12. When the jack screw 57 is turned or rotated in a counter-clockwise direction, the jaw screw 57 moves longitudinally upwardly in the threaded apertures in the collars 70 of the pivot pin 22 and locking pin 52 and the motor mounting bracket 44, 46 moves with the jack screw 57 and is raised relative to the transom mounting fixture 14, thusly, also raising the motor relative to the boat transom 12.

In operation, to tilt the outboard motor affixed to the motor mounting device 10, the threaded fasteners 68 and screw 80 holding the locking plate 72, 172 tightly in place on the flange 18, 20 of the transom mounting bracket 44, 46 are loosened freeing the locking pins 52 to move along the slot 26. Next, the motor mounting brackets 44, 46 of the motor mounting fixture 16 is manually pivoted in the selected rotational direction about the pivot pin 22 as the locking pin moves along the slot 26 until a desired tilt angle of the motor mounting bracket 44, 46 relative to the transom mounting bracket 28, 30 is reached, thusly, also tilting the motor relative to the boat transom 12. The screw 80 holding the lock plate 72, 172 to the flange 18, 20 of the transom mounting fixture 14 is tightened preventing further movement of the locking pin 52 along the slot 26, and the fasteners 68 are tightened on the pivot pin 22 and locking pin 52.

Figure 10:
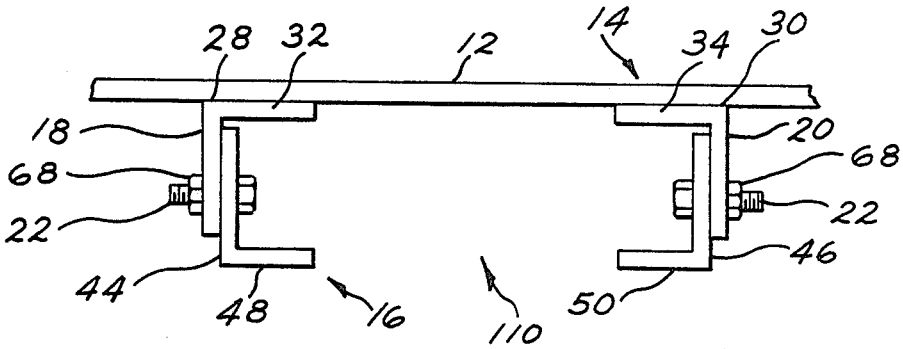
FIG. 10 is a top view of a modified outboard motor mounting device of the present invention.
Figure 11:
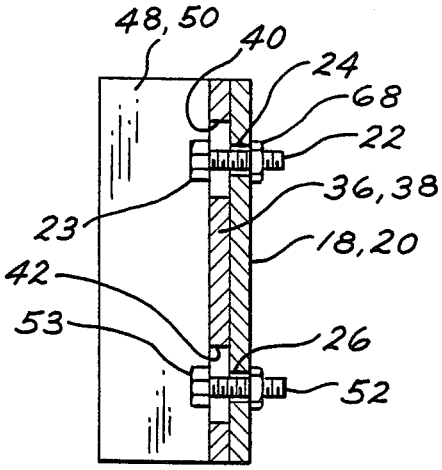
FIG. 11 is a cross-sectional view as seen in the direction of arrows 11—11 in FIG. 10.
Figure 12:
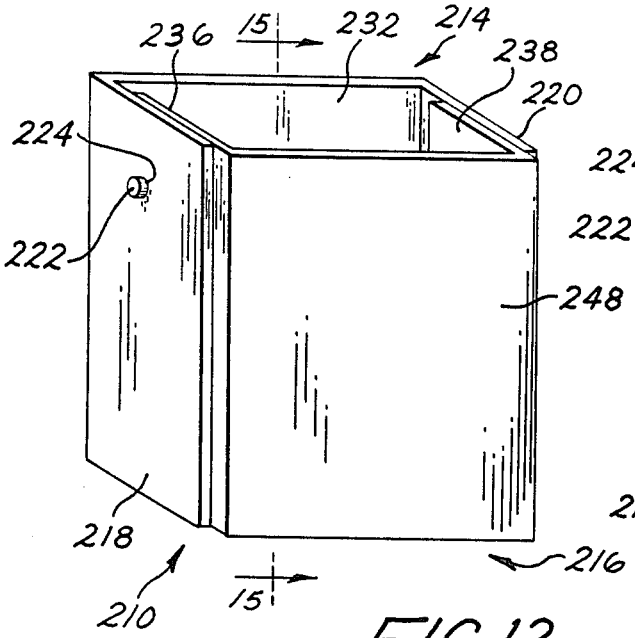
FIG. 12 is a perspective view of another embodiment of an outboard motor mounting device of the present invention.
Figure 13:
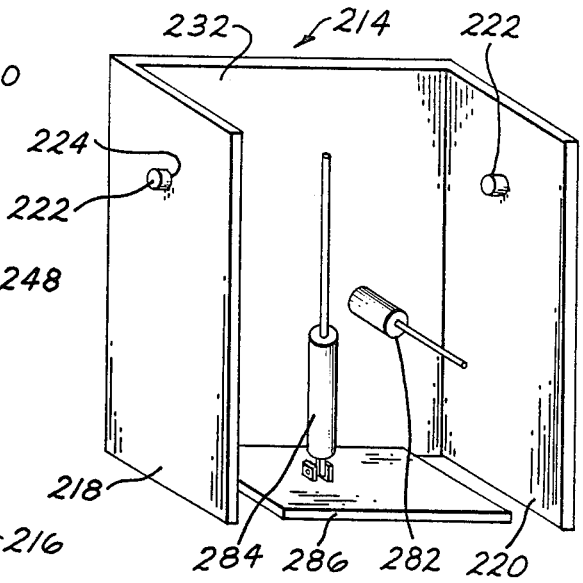
FIG. 13 is a perspective view of one component of the motor mounting device of FIG. 12.
Figure 14:
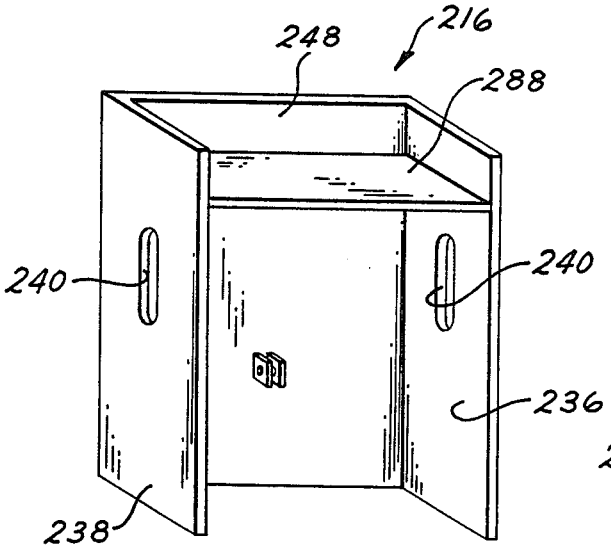
FIG. 14 is a perspective view of another component of the motor mounting device of FIG. 12.
Figure 15:
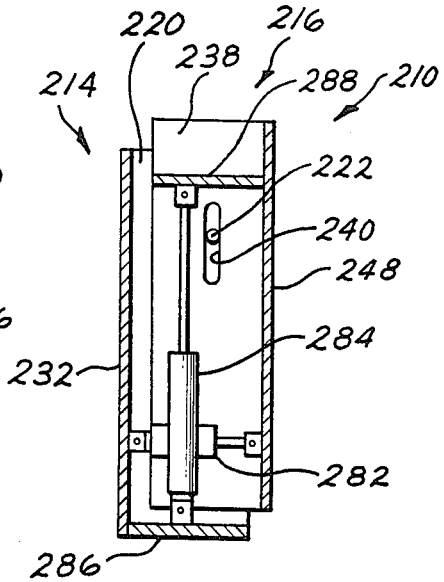
FIG. 15 is a cross-sectional view of the motor mounting device as seen in the direction of arrows 15—15 in FIG. 12.

FIGS. 10 and 11 illustrate a somewhat different embodiment of an outboard motor mounting device, generally denoted as the numeral 110, which is identical to the outboard motor mounting device 10 except for the jack screw means 54 which is absent in the outboard motor mounting device 110. In the outboard motor mounting bracket device 110, the pivot pin 22 has an enlarged head 23 which is larger than the width of the first elongated slot 40 in the flange 36, 38 of the motor mounting fixture 16, and the motor mounting fixture locking pin 52 has an enlarged head which is larger than the width of the second elongated slot 42 in the flange 36, 38 of the motor mounting fixture 16.

With reference to FIGS. 12–15, there is shown yet another embodiment of an outboard motor mounting device, generally denoted as the numeral 210 of the present invention.

The device 210 consists of a transom mounting fixture 214, and a motor mounting fixture 216.

The transom mounting fixture 214 comprises a pair of elongated spaced apart parallel flanges 218 and 220 unitary with and projecting from a planar transom mounting plate 232 which fits flulsh against the boat transom 12. Thus, the transom mounting fixture 214 is generally U-shaped in transverse cross-section.

The motor mounting fixture 216 comprises a pair of parallel, elongated spaced apart flanges 236 and 238 unitary with and projecting from a planar motor attachment plate 248. The pair of flanges 236, 238 are spaced apart from each other by a distance less than the distance between the transom mounting fixture flanges 218 and 220. Thus, the motor mounting fixture 216 is generally U-shaped in transverse cross-section.

The motor mounting flange 216 is positioned with respect to the transom mounting flange 214 such that the U-shaped transverse cross-sections face toward each other and the pair of flanges 236, 238 are received within the space between the transom mounting fixture flanges 218, 220 with one motor mounting fixture flange 236 located in parallel juxtaposition with one transom mounting fixture flange 218, and the other one of the motor mouting fixture flanges 238 in parallel juxtaposition with the other one of the transom mounting fixture flanges 220.

A different one of two motor mounting fixture pivot pins 222 projects from each of the transom mounting flanges 218 and 220 in coaxial alignment with each other to define a horizontal tilt axis of the motor mounting fixture 216. Toward this end, each pivot pin 222 is received through a hole 224 formed in each of the flanges 218 and 220. An elongated slot 240 is formed in each of the motor mounting fixture flanges 236 and 238 with the major axis in the direction of the vertical movement of the motor mounting fixture 216, that is, the major axis of the elongated slot 240 is parallel to the longitudinal axis of the elongated flanges 236 and 238. The motor mounting fixture pivot pin 222 received through the hole 224 in the transom mounting fixture flange 218 is also received through the elongated slot 240 in the motor mounting fixture flange 236 in juxtaposition to the flange 218, and the motor mounting fixture pivot pin 222 received through the hole 224 in the other transom mounting fixture flange 220 is also received through the elongated slot 240 in the motor mounting fixture flange 238 in juxtaposition to the flange 220. The pivot pins 222 each have an enlarged head 223 which is larger than the width of the elongated slots 240. A threaded fastener 268, such as a machine nut, is threaded over the end of each of the pivot pins 222 projecting through the holes 224 of the transom mounting fixture flanges 218 and 220.

A first pneumatic or hydraulic cylinder device 282 interconnects the transom mounting fixture 214 and motor mounting fixture 216 to effect tilting movement of the motor mounting fixture 216 relative to the transom mounting fixture 214 about the horizontal tilt axis defined by the pivot pins 222. As shown, the cylinder device 282 is positioned below the pivot pins 222 and the cylinder of the cylidner device 282 is pivotally affixed to the transom mounting plate 214 between the parallel flanges 218 and 220 with the operating rod of the cylinder device 282 extending perpendicular to the transom mounting plate 214. The pivot axis of the cylinder of the cylinder device 282 to the transom mounting plate 214 is parallel to the horizontal tilt axis defined by the pivot pins 222. The operating rod of the cylinder device 282 is attached to motor attachment plate 248 of the motor mounting fixture 216. As the cylinder device 282 is actuated to extend the operating rod, the motor mounting fixture 216 is caused to pivot outwardly about the pivot pins 222, thusly, tilting the motor attached to the motor mounting fixture 216 outwardly relative to the boat transom 12, and when the cylinder device 282 is actuated to retract the operating rod, the motor mounting fixture 216 is caused to pivot in the other or inwardly direction about the pivot pins 222, thusly, tilting the motor inwardly relative to the boat transom.

A second pneumatic or hydraulic cylinder device 284 interconnects the transom mounting fixture 214 and motor mounting fixture 216 to effect raising and lowering of the motor mounting fixture 216 relative to the transom mounting fixture 214 in a direction along the parallel flanges 218, 220 and parallel flanges 236, 238. As shown, the cylinder device 284 is positioned between the transom mounting flanges 218, 220 and the cylinder of the cylinder device 284 is pivotally affixed to a cross-member 286 extending across the transom mounting flanges 218, 220 at the lower end of the transom mounting fixture 214 with the pivot axis of the cylinder of the cylinder device 284 parallel to the horizontal tilt axis defined by the pivot pins 222. The operating rod of the cylinder device 284 extends upwardly parallel to the transom mounting flanges 218, 220 and is affixed to a cross-member 288 extending across the motor mounting flanges 236, 238 at the top end of the motor mounting fixture 216. As the cylinder device 284 is actuated to extend the operating rod, the motor mounting fixture 216 is raised, thusly, raising the motor relative to the boat transom 12, and when the cylinder device 284 is actuated to retract the opoerating rod, the motor mounting fixture 216 is lowered, thusly, lowering the motor relative to the boat transom 12.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

I claim:

1. A device for mounting an outboard motor on the transom of a boat so that the motor can be selectively raised, lowered and titled relative to the boat transom, comprising:

a transom mounting fixture adapted to be fixedly attached to the boat transom against movement relative to the boat transom;

a motor mounting fixture to which the outboard motor is affixed interconnected directly to the transom mounting fixture for vertical linear infinitely variable movement, between limits, relative to the transom mounting fixture, and for independent pivotal infinitely variable movement, between limits, relative to the transom mounting fixture about a horizontal axis parallel to the boat transom such that the motor mounting fixture moves in the direction of the longitudinal axis of the boat to which the device is attached;

means for locking the motor mounting fixture in the selected position relative to the transom mounting fixture;

a jack screw located with the longitudinal axis of the jack screw in alignment with the linear direction of movement of the motor mounting fixture; means for mounting the jack screw to the motor mounting fixture for rotational movement about the longitudinal axis of the jack screw and holding the jack screw fast against movement along the longitudinal axis of the jack screw relative to the motor mounting fixture; and, means interconnecting the transom mounting fixture to the jack screw for providing movement to the jack screw in the direction of the longitudinal axis of the jack screw relative to the transom mounting fixture as the jack screw is turned about the longitudinal axis of the jack screw;

thereby moving the motor mounting fixture with the jack screw relative to the transom mounting fixture linearly in the direction of the longitudinal axis of the jack screw as the jack screw is rotated about its longitudinal axis.

2. A device for mounting an outboard motor on the transom of a boat so that the motor can be selectively raised, lowered and tilted relative to the boat transom, comprising:

a transom mounting fixture adapted to be fixedly attached to the boat transom against movement relative to the boat transom;

a motor mounting fixture to which the outboard motor is affixed interconnected directly to the transom mounting fixture for vertical linear infinitely variable movement, between limits, relative to the transom mounting fixture, and for independent pivotal infinitely variable movement, between limits, relative to the transom mounting fixture about a horizontal axis parallel to the boat transom such that the motor mounting fixture moves in the direction of the longitudinal axis of the boat to which the device is attached, the motor mounting fixture comprising:

(a) a pair of spaced apart, parallel elongated flanges;

(b) a motor mounting fixture pivot pin projecting perpendicularly from each of the flanges and in coaxial alignment with each other defining the pivotal axis of the motor mounting fixture relative to the transom mounting fixture; and, (c) an elongated slot formed in each of the flanges spaced a distance from the pivot pin along the longitudinal axis of the flange, the major axis of the slot being generally transverse to the direction of linear movement of the motor mounting fixture; and (d) means for locking the motor mounting fixture in the selected position relative to the transom mounting fixture.

3. The outboard motor mounting device of claim 2, wherein the motor mounting fixture comprises:

a pair of spaced apart, parallel flanges, the motor mounting fixture flanges being spaced apart by a distance less than the distance between the transom mounting fixture flanges, the pair of motor mounting fixture flanges being received between the pair of spaced apart transom mounting fixture flanges with one flange of the transom mounting fixture located in overlaying juxtaposition with one flange of the motor mounting fixture and the other one of the flanges of the transom mounting fixture located in overlaying juxtaposition with the other one of flanges of the motor mounting fixture;

a first elongated slot formed in each of the motor mounting fixture flanges, the major axis of the first slot being in the direction of the linear movement of the motor mounting fixture, each first elongated slot receiving the pivot pin projecting from the juxtaposed transom mounting fixture flange;

a second elongated slot formed in each of the motor mounting fixture flanges spaced a distance from the first elongated slot with the major axis of the second elongated slot in alignment with the major axis of the first elongated slot; and, a motor mounting fixture locking pin received through the elongated slot in each of the transom mounting fixture flanges and through the second elongated slot in each of the motor mounting fixture flanges.

4. The outboard motor mounting device of claim 3, further comprising:

a jack screw located next to each one of the motor mounting fixture flanges with the longitudinal axis of the jack screw in alignment with the major axes of the first and second elongated slots in the motor mounting fixture flanges, the jack screw being mounted to the motor mounting fixture for rotational movement about the longitudinal axis of the jack screw and held fast against movement along the longitudinal axis of the jack screw;

means threadably interconnecting the pivot pin of the motor mounting fixture flange adjacent the jack screw and the jack screw for providing movement of the jack screw in the direction of the longitudinal axis of the jack screw relative to the pivot pin; and, means threadably interconnecting the locking pin of the motor mounting fixture flange adjacent the jack screw and the jack screw for providing movement of the jack screw in the direction of the longitudinal axis of the jack screw relative to the locking pin;

thereby providing for the movement of the motor mounting fixture relative to the transom mounting fixture linearly in the direction of the longitudinal axis of the jack screw.

5. The outboard motor mounting device of claim 3, further comprising a lock plate associated with the locking pin and affixed to the transom mounting bracket flange for preventing the locking pin from moving along the major axis of the elongated slot of the motor mounting fixture flange.

6. A device for mounting an outboard motor on the transom of a boat so that the motor can be selectively raised, lowered and tilted relative to the boat transom, comprising:

a transom mounting fixture adapted to be fixedly attached to the boat transom against movement relative to the boat transom, the transom mounting fixture consists of two mirror image transom mounting brackets, each bracket comprising:

a transom attachment plate adapted to be affixed to the boat transom;

a elongated flange unitary with teh transom attachment plate and extending at an angle therefrom;

a motor mounting fixture pivot pin projecting perpendicularly from the flange; and, a slot formed in the flange spaced a distance from the pivot pin along the longitudinal axis of the elongated flange, the major axis of the slot being generally transverse to the longitudinal axis of the elongated flange;

a motor mounting fixture to which the outboard motor is affixed interconnected directly to the transom mounting fixture for vertical linear infinitely variable movement, between limits, relative to the transom mounting fixture, and for independent pivotal infinitely variable movement, between limits, relative to the transom mounting fixture about a horizontal axis parallel to the boat transom such that the motor mounting fixture moves in the direction of the longitudinal axis of the boat to which the device is attached, the motor mounting fixture consists of two mirror image motor mounting brackets, each bracket comprising:

a motor attachment plate to which the outboard motor is to be attached;

an elongated flange unitary with the motor attachment plate and extending at an angle therefrom;

the motor mounting bracket being positioned relative to the transom mounting bracket such that the elongated flange of the transom mounting bracket overlays the elongated flange of the motor mounting bracket;

a first elongated slot formed in the elongated flange of the motor mounting bracket, the major axis of the first slot being in the direction of the longitudinal axis of the elongated flange of the motor mounting bracket;

the pivot pin projecting from the elongated flange of the transom mounting bracket being received in the first elongated slot of the elongated flange of the motor mounting bracket; and, a second elongated slot formed in the elongated flange of the motor mounting bracket spaced a distance from the first elongated slot with the major axis of the second elongated slot in alignment with the major axis of the first elongated slot;

a motor mounting fixture locking pin received through the elongated slot of the elongated flange of the transom mounting bracket and through the second elongated slot in the motor mounting bracket; and means for locking the motor mounting fixture in the selected position relative to the transom mounting fixture.

7. The outboard motor mounting device of claim 6, further comprising:

a jack screw located next to the elongated flange of the motor mounting bracket with the longitudinal axis of the jack screw in alignment with the longitudinal axis of the first elongated slot and second elongated slot, the jack screw being mounted to the motor mounting bracket for rotational movement about the longitudinal axis of the jack screw and held fast against movement along the longitudinal axis of the jack screw;

means threadably interconnecting the pivot pin and the jack screw for providing movement of the jack screw relative to the pivot pin in the direction of the longitudinal axis of the jack screw; and, means threadably interconnecting the locking pin and jack screw for providing movement of the jack screw relative to the locking pin in the direction of the longitudinal axis of the jack screw;

thereby providing for the movement of the motor mounting bracket relative to the transom mounting bracket in the direction of the longitudinal axis of the jack screw.

8. A device for mounting an outboard motor on the transom of a boat so that the motor can be selectively raised, lowered and tilted relative to the boat transom comprising:

a transom mounting fixture adapted to be fixedly attached to the boat transom against movement relative to the boat transom;

a motor mounting fixture to which the outboard motor is affixed interconnected directly to the transom mounting fixture for vertical linear infinitely variable movement, between limits, relative to the transom mounting fixture, and for independent pivotal infinitely variable movement, between limits, relative to the transom mounting fixture about a horizontal axis parallel to the boat transom such that the motor mounting fixture moves in the direction of the longitudinal axis of the boat to which the device is attached;

a first fluid operated cylinder device interconnecting the transom mounting fixture and motor mounting fixture for pivotally moving the motor mounting fixture relative to the transom mounting fixture; and a second fluid operated cylinder device interconnecting the transom mounting fixture and motor mounting fixture for linearly moving the motor mounting fixture relative to the transom mounting fixture.

9. A device for mounting an outboard motor on the transom of a boat so that the motor can be selectively raised, lowered, and tilted relative to the boat transom, comprising:

(a) a transom mounting fixture comprising:

a transom mounting plate to be attached to the boat transom;

a pair of spaced apart, parallel, elongated flanges unitary with the mounting plate and projecting at an angle therefrom;

a pivot pin extending perpendicularly from each of the elongated flanges in coaxial alignment with each other defining a pivot axis;

(b) a motor mounting fixture comprising:

a motor mounting plate to which an outboard motor is to be attached;

a pair of spaced apart, parallel elongated flanges unitary with the motor mounting plate and projecting at an angle therefrom, and, an elongated slot formed in each of the flanges of the motor mounting flanges, the major axis of the elongated slot being generally in alignment with the longitudinal axis of the elongated flange in which it is formed;

the motor mounting fixture being positioned relative to the transom mounting flange such that each of the elongated flanges of the motor mounting fixture overlays a different one of the elongated flanges of the transom mounting fixture and with the pivot pin extending from each of the elongated flanges of the transom mounting fixture being received through the elongated slot in the overlaying one of the elongated flanges of the motor mounting bracket;

(c) a first fluid operated cylinder device interconnected to the transom mounting fixture and motor mounting fixture with its operating rod generally perpendicular to the major axis of the elongated slots in the elongated flanges of the motor mounting fixture for pivotally moving the motor mounting fixture relative to the transom mounting fixture about the axis of the pivot pin as the operating rod extends and retracts; and, (d) a second fluid operated cylinder device interconnected to the transom mounting fixture and motor mounting fixture with its operating rod generally parallel to the major axes of the elongated slots in the elongated flanges of the motor mounting fixture for linearly moving the motor mounting fixture relative to the transom mounting fixture in the direction of the major axes of the slots as the operating rod extends and retracts.

* * * * *